United States Patent [19]

Williams

[11] Patent Number: 4,786,210

[45] Date of Patent: Nov. 22, 1988

[54] ARCTIC PRODUCTION/TERMINAL FACILITY

[75] Inventor: Thomas E. Williams, Argyle, Tex.

[73] Assignee: Mobil Oil Corporation, New York, N.Y.

[21] Appl. No.: 96,868

[22] Filed: Sep. 14, 1987

[51] Int. Cl.[4] ..... E02B 15/02; E02B 17/02

[52] U.S. Cl. ..... 405/217; 405/1; 405/61

[58] Field of Search ..... 405/1, 61, 195, 211, 405/218, 217

[56] References Cited

U.S. PATENT DOCUMENTS 4,058,982 11/1977 Wright ..... 405/211

4,326,822 4/1982 Oshima et al. ..... 405/217

4,335,980 6/1982 DePriester ..... 405/217

*Primary Examiner*—David H. Corbin

*Attorney, Agent, or Firm*—Alexander J. McKillop; Michael G. Gilman; Charles J. Speciale

[57] ABSTRACT

An offshore facility for use in an arctic body of water to produce, store, and offload hydrocarbons. The facility comprises a main structure which includes storage tanks, production equipment, etc., and which has a marine docking slip constructed therein and adapted to receive and moor a vessel, e.g., a tanker ship, therein to protect the vessel against moving ice. To protect the vessel while it is moored in the slip, a means is provided to keep the water in the slip from freezing.

13 Claims, 1 Drawing Sheet

ARCTIC PRODUCTION/TERMINAL FACILITY

TECHNICAL FIELD

The present invention relates to an offshore production/terminal facility for use in arctic waters, said facility having an integral marine docking slip therein whereby the facility is operational the year around.

BACKGROUND ART

In recent years, large deposits of hydrocarbons have been discovered at offshore locations in arctic areas of the world. In such locations, it is impractical to lay a pipeline to the production site to transport the produced hydrocarbons. Accordingly, the hydrocarbons normally have to be stored at the production site and then offloaded onto tanker ships for transport.

The tankers are normally loaded while they are moored to a terminal facility (e.g., a single leg moor) which is positioned in open water so that the tanker is free to "weathervane" about the terminal with the change in current. As known, most waters in these arctic areas either freeze or have pack ice and/or ice floes therein during the extreme cold period of the year. This makes the offloading onto tankers during this period extremely hazardous if possible at all. That is, a tanker may be frozen into the ice mass while it is moored to the terminal or it may be crushed or otherwise damaged by moving ice in the area.

Since the storage capacity at an offshore production facility is limited, the inability to offload produced hydrocarbons during the extended period of ice formation will usually require that the production be shut in for a like period. As can be imagined, this interruption of production is extremely costly and, in some instances, may adversely affect the overall performance of the field. Accordingly, a need exists for a production and offloading facility for arctic locations which can operate year around in all ambient conditions, including freezing conditions where ice is present at said facility.

DISCLOSURE OF THE INVENTION

The present invention provides an offshore facility for use in a body of water in an arctic area to develope an underwater source of hydrocarbons and then to produce, store, and offload said hydrocarbons therefrom. The facility comprises a main structure which includes storage tanks, production equipment, etc., and which has an marine docking slip constructed therein as an integral part thereof.

The slip opens into the main structure through the back thereof and is adapted to receive and moor a vessel, e.g., a tanker ship, therein. When the vessel is moored in the slip, it is completely inside the periphery of the facility and is thereby protected against moving pack ice and/or ice floes in the area. Since the front of the facility is positioned towards the direction from which the flow of the pack ice or ice floes is normally expected, there is little possibility that any ice will enter the opening of the slip which is through the back of the facility.

To further protect the vessel while it is moored therein, means are provided adjacent the slip to keep the water in the slip from freezing. This means comprises means for pumping water from the bottom of the slip to the water surface within the slip or means to circulate air above the water surface in the slip or a combination of both.

BRIEF DESCRIPTION OF THE DRAWINGS

The actual construction, operation, and apparent advantages of the present invention will be better understood by referring to the drawings in which like numerals identify like parts and in which.

BEST MODE FOR CARRYING OUT THE INVENTION

Figure 1:
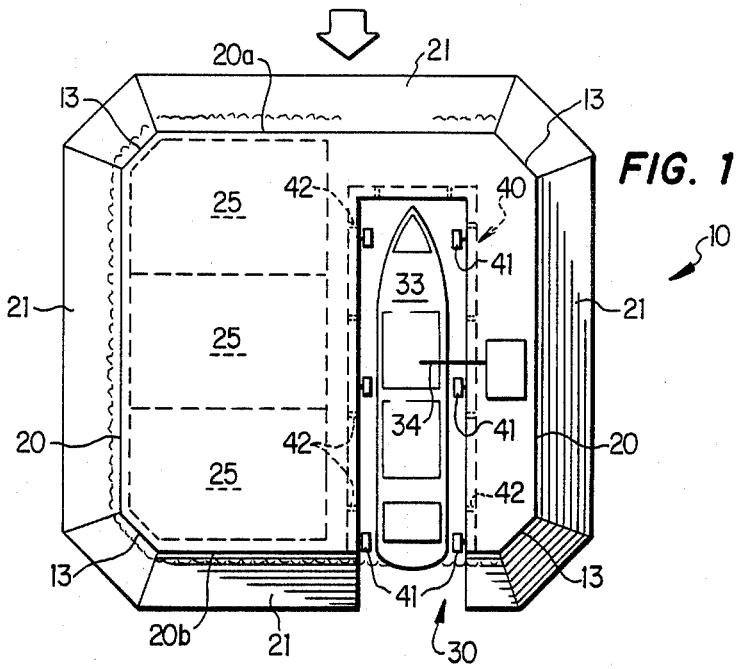
FIG. 1 is a top view of the offshore facility in accordance with the present invention.
Figure 2:
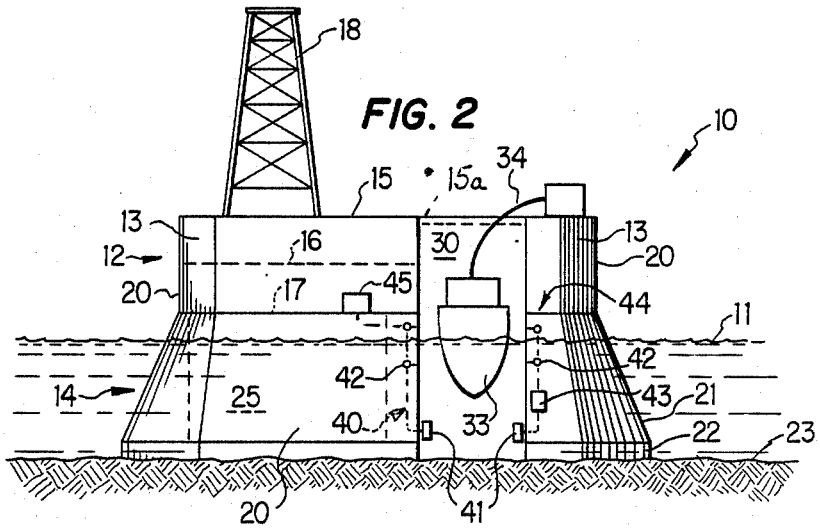
FIG. 2 is a side view of the offshore facility of FIG. 1.

Referring more specifically to the drawings, FIGS. 1 and 2 disclose a production and terminal facility 10 which is in position in a body of water 11 at an offshore, arctic site. As illustrated, facility 10 is comprised of a main structure having an upper section 12 and an integral skirt section 14. Upper section 12 preferably is substantially square (having sides 20, front 20*a*, and back 20*b*) in configuration with corners 13 thereof beveled as shown, for a purpose to be discussed below. Section 12 may include several decks 15, 16, 17 (three shown in FIG. 2) on which routine production equipment, etc. are positioned. Top deck 15 may also include a derrick 18 for load handling or certain work-over operations, etc., a helio-port (not shown), and other structures and equipment commonly found on production/terminals of this general type.

Skirt section 14 is integral and conforms with section 12 and has sides 21 which extend above the waterline and slope outwardly and downwardly to base 22 which, in turn, rests on marine bottom 23 at the offshore site. Accordingly, any moving pack ice or individual ice floes or the like in water 11 will first contact the sloping sides 21 of section 14 and will ride up onto the sides, thereby breaking up the ice before it does any damage to facility 10. Also, beveled corners 13 on both upper section 12 and skirt section 14 serve to deflect moving ice away from facility 10, as will be understood in the art. Skirt section 14 has one or more storage tanks or compartments 25 (three shown in FIG. 1) therein for storing the hydrocarbons or the like produced from subsea wells (not shown) which are completed on or near facility 10.

Forming an integral part of facility 10 is marine docking slip 30. Slip 30 extends vertically from top to bottom of facility 10 and opens through back 20*b* for allowing tanker ship 33 or other marine vessels to enter and dock therein. When tanker 33 is moored within slip 30, it is completely within the periphery of facility 10 and is thereby protected from pack ice and/or ice floes.

To protect against ice from entering the opening of slip 30, facility 10 is positioned during initial construction so that front 20*a* will lie directly facing into the direction (heavy arrow in FIG. 1) from which the flow of the pack ice and/or ice floes is normally expected. Accordingly, under expected conditions, any moving ice will first contact front 20*a* and will be broken up thereby and will deflect away from facility 10 leaving little possibility that any ice will enter slip 30 from the back or downstream side of facility 10.

Once tanker 33 is securely moore within slip 30, it can be safely loaded with hydrocarbons from storage tanks 25 through line 34 or equivalent known offloading equipment. By being substantially enclosed within the periphery of facility 10, tanker 33 is protected from moving ice while it is dead in the water and taking on cargo.

To further protect ship 33 while it is moored within slip 30, means are provided to prevent the water within the slip from freezing. One such means comprises manifold system 40 which, in turn, is comprised of a network of interconnected conduits within facility 10 which are positioned around the periphery of slip 30. One or more pumps 41 are positioned on or near marine bottom 22 within slip 30 for pumping water from near the bottom through a plurality of outlets 42 (FIGS. 1 and 2) at or below the surface of water in slip 30. Due to the warmer temperature of the water near the bottom and the constant agitation caused by the pumping operation, this alone may be enough to prevent freezing. If not, the water as it is pumped can be routed through heaters 43 (FIG. 2) which, in turn, utilize part of the stored hydrocarbons as fuel.

Another means for preventing the water from freezing within slip 30 comprises a manifold 44 which is an interconnecting network of conduits which are positioned around the upper periphery of slip 30 and which are adapted to open into the slip above the surface of the water. A blower 45 circulates air through manifold 44 above the surface of the water to prevent freezing. Blower 45 can supply ambient air or more preferably supply heated air from various equipment on facility 10, e.g., exhaust from engines, waste heat from turbines, etc. To aid in maintaining a non-freezing temperature within slip 30, a temporary or permanent cover 15*a* (FIG. 2) may be constructed over the top of slip 30.

It should be recognized that facility 10 can be constructed by any of several techniques now used in constructing offshore structures of this general type. That is, facility 10 can be constructed in place; built substantially in drydock and floated to location; built in modules which are then floated and assembled on site; etc. Also, facility 10 can be constructed of metal sheeting or the like or can be of a reinforced concrete construction as is well known in the art. Further, additional supports and bracing may be used to strengthen slip 30 within facility 10, if required.

Of course, the particular configuration and dimensions of a particular facility 10 may vary depending on the actual environment and conditions of use, but the following is considered to be a representative example of a typical facility which might be designed to operate in 50 feet of water. The length of the sides of upper section 12 would be approximately 900 to 1000 feet with the height of the facility being approximately 90 feet. Slip 30 would have dimensions of approximately 700 feet long and 150 to 200 feet wide.

Figure 3:
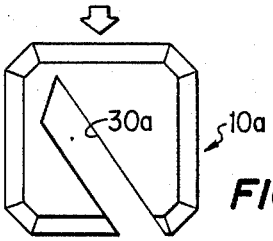
FIG. 3 is a top view of another embodiment of the present invention.

FIG. 3 disclosed a production/terminal facility 10*a* which is substantially the same as facility 10 described above except slip 30*a* is constructed to extend substantially diagonally inward into facility 10*a*. This allows larger tankers to be accommodated while the other basic dimensions of facility 10 remain substantially the same.

As should be recognized, the present facility, as disclosed, may also be used during the exploration and drilling phase of the development of an offshore field in an arctic area prior to its use as a production, storage, and offloading facility in that slip 30 will function as a dock for the necessary supply barges in all types of weather conditions. It is understood that "ice-strengthened vessels" and tankers may have to be used to service facility 10 in the extreme cold season and that "ice-breaker" vessels may have to be used to provide passage for such service vessels. Nevertheless, facility 10 provides the necessary protection for the service vessel during the time it is most vulnerable to ice damage; that being while it is moored at the facility.

What is claimed is:

1. An offshore facility for use in a body of water in an arctic area, said facility comprising:
   a main structure having a front and a back and a base adapted to rest on the bottom of said body of water; and
   a marine slip formed integral within said main structure, said slip opening through said back of said structure and extending inwardly into said main structure and adapted to receive and moor a vessel therein whereby said vessel shall be completely inside the periphery of said facility when in a moored position within said slip.

2. The offshore facility of claim 1 including:
   means for preventing freezing of said body of water inside said slip.

3. The offshore facility of claim 2 wherein said means for preventing freezing comprises:
   means for pumping water from the bottom of said slip to the surface of the water in said slip.

4. The offshore facility of claim 3 wherein said means for preventing freezing includes:
   means for heating said water as it is being pumped from the bottom to the surface of the water in said slip.

5. The offshore facility of claim 2 wherein said means for preventing freezing comprises:
   means for circulating air above the surface of the water in said slip.

6. The offshore facility of claim 1 wherein said main structure comprises:
   an upper section; and
   a skirt section integral with said upper section, said skirt section having sides sloping downward and outward from said upper section to said base.

7. The offshore facility of claim 6 including:
   at least one compartment in said skirt section for storing fluids.

8. The offshore facility of claim 7 including
   at least one deck in said upper section adapted to have hydrocarbon production equipment mounted thereon.

9. The offshore facility of claim 8 including:
   means for preventing freezing of said body of water inside said slip.

10. The offshore facility of claim 9 wherein said means for preventing freezing comprises:
   means for pumping water from the bottom of said slip to the surface of the water in said slip.

11. The offshore facility of claim 10 wherein said means for preventing freezing includes:
   means for heating said water as it is being pumped from the bottom to the surface of the water in said slip.

12. The offshore facility of claim 9 wherein said means for preventing freezing comprises:
   means for circulating air above the surface of the water in said slip.

13. The offshore facility of claim 9 wherein said front of said facility is positioned in said body of said water to face directly into the direction from which the flow of ice in said arctic area is normally expected.

* * * * *